US007386445B2

(12) United States Patent
Ojala

(10) Patent No.: US 7,386,445 B2
(45) Date of Patent: Jun. 10, 2008

(54) COMPENSATION OF TRANSIENT EFFECTS IN TRANSFORM CODING

(75) Inventor: Pasi Ojala, Kauniainen (FI)

(73) Assignee: Nokia Corporation, Espoo (FI)

( * ) Notice: Subject to any disclaimer, the term of this patent is extended or adjusted under 35 U.S.C. 154(b) by 643 days.

(21) Appl. No.: 11/039,391

(22) Filed: Jan. 18, 2005

(65) Prior Publication Data

US 2006/0161427 A1 Jul. 20, 2006

(51) Int. Cl.
*G10L 19/12* (2006.01)

(52) U.S. Cl. ..... 704/219; 704/203

(58) Field of Classification Search ..... 704/219, 704/203

See application file for complete search history.

(56) References Cited

U.S. PATENT DOCUMENTS 6,044,089 A * 3/2000 Ferriere ..... 370/465
6,199,035 B1 * 3/2001 Lakaniemi et al. ..... 704/207
6,202,045 B1 * 3/2001 Ojala et al. ..... 704/203
6,266,644 B1 * 7/2001 Levine ..... 704/503
6,470,313 B1 * 10/2002 Ojala ..... 704/223
6,584,441 B1 * 6/2003 Ojala et al. ..... 704/500
6,615,169 B1 * 9/2003 Ojala et al. ..... 704/205
2003/0115052 A1 6/2003 Chen et al.

OTHER PUBLICATIONS

Signal Processing with Lapped Transforms by Henrique S. Malvar, (1992) Chapter 4, p. 143-173.

* cited by examiner

*Primary Examiner*—Susan McFadden
(74) *Attorney, Agent, or Firm*—Ware, Fressola, Van Der Sluys & Adolphson LLP

(57) ABSTRACT

The present invention provides a method for compensating transient effects in transform coding and decoding of a combined speech and audio in electronic devices by using a transform based time-frequency domain codec. The method can combine, e.g., a CELP (code excited linear prediction) type speech codec and a transform type audio codec. The invention describes a compensation method to handle the transient (e.g., from the CELP coding to the transform coding) in transform coding when the number of quantized transform coding coefficients is lower than in the output of the transform.

75 Claims, 6 Drawing Sheets

COMPENSATION OF TRANSIENT EFFECTS IN TRANSFORM CODING

TECHNICAL FIELD

This invention generally relates to a speech and audio coding, and more specifically to a combined speech and audio coding by compensating transient effects in transform coding and decoding by using a transform based time-frequency domain codec.

BACKGROUND ART

Typically, speech coding and audio (e.g., for music) coding at low bit-rates are approached differently. The speech coding is based on a speech production model with hybrid model and waveform based coding of an input signal. The speech production model parameters are quantized in a time domain. On the other hand, the audio coding utilizes transform coding in which the coding gain is achieved in the transform itself and in perceptual masking of transform coefficients before quantization.

Combining the model based time domain speech codec and transform based time-frequency domain codec has been a difficult task. There are no examples of successful algorithms achieving this goal without extensive delay in the algorithm to handle the transient from the time domain quantization to the transform coding.

DISCLOSURE OF THE INVENTION

The object of the present invention is to provide a novel method for compensating transient effects in transform coding and decoding in electronic devices by using a transform based time-frequency domain codec.

According to a first aspect of the invention, a method for encoding an acoustic signal, comprises the steps of: encoding a first frame of an acoustic signal using a first encoding method; and encoding a transient frame of an acoustic signal which follows the first frame and contains M samples using a second encoding method for producing a set of M+K encoding values, wherein M and K are pre-selected integers of at least a value of one.

According further to the first aspect of the invention, a decision for using the first encoding method or the second encoding method may be made based on a pre-selected criterion.

Further according to the first aspect of the invention, the first encoding method may be a time domain codec, optionally a code excited linear prediction (CELP).

Still further according to the first aspect of the invention, the encoding the transient frame may comprise the steps of: performing a transform analysis of the transient frame for generating in a frequency domain M transient transform coefficients; performing the transform analysis of at least one further frame for generating in the frequency domain K further transform coefficients, wherein the further frame contains selected samples from both the first frame and the transient frame and the selected samples are chosen based on a predetermined algorithm; and combining the M transient transform coefficients and the K further transform coefficients using a predetermined procedure, wherein the M+K combined transform coefficient are the M+K encoding values for the transient frame. Further, at least one further frame may incorporate an ending part of the first frame and a beginning part of the transient frame based on the predetermined algorithm. Further still, the M transform coefficients may correspond to a long transient window with a length of L samples, and the K further transform coefficients may correspond to a short transient window with a length of $L_s$ samples, and wherein L and $L_s$ are pre-selected integers with L>M and $L_s$>K. Yet still further, the long transient window may start from a first sample of the transient frame and extends over a following frame, and optionally L=2M and $L_s$=2K. Still further, the transform analysis may be a lapped transform analysis or a modified discrete cosine transform (MDCT) analysis.

According further to the first aspect of the invention, the combining the M transform coefficients and the K further transform coefficients based on the predetermined procedure may generate M+K transform coefficients X(j), wherein an index j=0, 1, . . . , M+K−1 and at least one of the transform coefficients X(M+i) is not equal to zero when a further index i is equal to 0, 1, . . . or K−1. Further still, the method may further comprise the steps of: setting the transform coefficients X(M+i) to zero, thus completing the encoding the transient frame; and sending all encoded frames including the transient frame for decoding.

According still further to the first aspect of the invention, all steps of the first aspect of the invention may be performed by an electronic device, and the method may further comprises the steps of: receiving all encoded frames by a further electronic device; decoding the first frame in the time domain by the further electronic device, wherein the first encoding method is a time domain codec; and decoding by the further electronic device the encoded transient frame to the time domain using the non-zero first M transform coefficients in the frequency domain, thus compensating transient effects in transform coding. Further, the decoding of the encoded transient frame may be performed by using at least one of the transform coefficients X(M+i) set to a non-zero value based on a predetermined criterion by the further electronic device. Still further, the transform coefficients X(M+i) during the decoding may be calculated as follows:

$$X(M+i)=X(M-K+i) \text{ or}$$

$$X(M+i)=X(M-i-1).$$

Further still, the transform coefficients X(M+i) during the decoding may be chosen randomly with a normalized gain, or the transient transform coefficients X(M+i) during the decoding may be chosen using linear prediction based on other coefficients out of the transient transform coefficients X(j) using a further predetermined criterion.

According further still to the first aspect of the invention, the electronic device may be an encoder, an electronic communication device, a mobile communication device or a mobile phone, or the electronic device may contain an encoder or a combination of the encoder and a decoder. Further, the further electronic device may be a decoder, an electronic communication device, a mobile communication device or a mobile phone, or the electronic device may contain a decoder or a combination of the decoder and an encoder.

According to a second aspect of the invention, a computer program product comprises: a computer readable storage structure embodying computer program code thereon for execution by a computer processor with the computer program code characterized in that it includes instructions for performing the steps of the first aspect of the invention.

According to a third aspect of the invention, a method for decoding to a time domain a frame of an acoustic signal encoded using a transform based frequency domain codec with M+K transform coefficients X(j), wherein an index j=0, 1, . . . , M+K−1, and with last K coefficients X(M+i) with a further index i=0, 1, . . . or K−1 set to zero, comprises the steps of: modifying the M+K transform coefficients X(j) with the K transform coefficients set to zero by setting at least one of the last K transform coefficients X(M+i) to a non-zero value based on a predetermined criterion; and performing an inverse transform of the M+K transform coefficients after the modifying, thus completing the decoding the frame of the acoustic signal to the time domain.

According further to the third aspect of the invention, the transform coefficients X(M+i) during the decoding may be calculated as follows:

$$X(M+i)=X(M-K+i) \text{ or}$$

$$X(M+i)=X(M-i-1).$$

Further according to the third aspect of the invention, the transform coefficients X(M+i) during the decoding may be chosen randomly with a normalized gain, or the transient transform coefficients X(M+i) during the decoding may be chosen using linear prediction based on other coefficients out of the transient transform coefficients X(j) using a further predetermined criterion.

Further according to the third aspect of the invention, the frame of the acoustic signal may follow a first frame of the acoustic signal encoded using a first encoding method, and the frame may be a transient frame containing M samples and encoded using a second encoding method for producing a set of the M+K transform coefficients X(j), wherein M and K are pre-selected integers of at least a value of one. Further, a decision for using the first encoding method or the second encoding method may be made based on a pre-selected criterion. Still further, the first encoding method may be a time domain codec, optionally a code excited linear prediction (CELP).

Still further according to the third aspect of the invention, the encoding the transient frame may comprise the steps of: performing a transform analysis of the transient frame for generating in a frequency domain M transient transform coefficients; performing the transform analysis of at least one further frame for generating in the frequency domain K further transform coefficients, wherein the further frame contains selected samples from both the first frame and the transient frame and the selected samples are chosen based on a predetermined algorithm; and combining the M transient transform coefficients and the K further transform coefficients using a predetermined procedure, thus generating the M+K combined transform coefficient X(j). Further, at least one further frame may incorporate an ending part of the first frame and a beginning part of the transient frame based on the predetermined algorithm. Still further, the M transform coefficients may correspond to a long transient window with a length of L samples, and the K further transform coefficients may correspond to a short transient window with a length of $L_s$ samples, and wherein L and $L_s$ are pre-selected integers with L>M and $L_s$>K. Yet still further, the long transient window may start from a first sample of the transient frame and extends over a following frame, and optionally L=2M and $L_s$=2K. Further, the transform analysis may be a lapped transform analysis or a modified discrete cosine transform (MDCT) analysis.

According further to the third aspect of the invention, before decoding the transient frame, the method may further comprise the step of: setting the transform coefficients X(M+i) to zero, thus completing the step of the encoding the transient frame; and sending all encoded frames including the transient frame for decoding. Further, the encoding of the acoustic signal may be performed by an electronic device, and before decoding the transient frame, the method may further comprise the steps of: receiving all encoded frames by a further electronic device; and decoding the first frame in the time domain by the further electronic device, wherein the steps of the modifying the M+K transform coefficients X(j) and the performing the inverse transform of the M+K transform coefficients is also performed by the further electronic device. Still further, the electronic device may be an encoder, an electronic communication device, a mobile communication device or a mobile phone, or the electronic device may contain an encoder or a combination of the encoder and a decoder. Yet still further, the further electronic device may be a decoder, an electronic communication device, a mobile communication device or a mobile phone, or the electronic device may contain a decoder or a combination of the decoder and an encoder.

According to a fourth aspect of the invention, a computer program product comprises: a computer readable storage structure embodying computer program code thereon for execution by a computer processor with the computer program code characterized in that it includes instructions for performing the third aspect of the invention.

According to a fifth aspect of the invention, an electronic device for encoding an acoustic signal, may comprise: means for encoding a first frame of an acoustic signal using a first encoding method; and a transient encoder for encoding a transient frame of an acoustic signal which follows the first frame and contains M samples using a second encoding method for producing a set of M+K encoding values, wherein M and K are pre-selected integers of at least a value of one.

According further to the fifth aspect of the invention, a decision for using the first encoding method or the second encoding method may be made based on a pre-selected criterion by the electronic device.

Further according to the fifth aspect of the invention, the first encoding method may be a time domain codec, optionally a code excited linear prediction (CELP). Still further according to the fifth aspect of the invention, the transient encoder for the encoding the transient frame may comprise: a long transform window block, for performing a transform analysis of the transient frame for generating in a frequency domain M transient transform coefficients; a short transform window block, for performing the transform analysis of at least one further frame for generating in the frequency domain K further transform coefficients, wherein the further frame contains selected samples from both the first frame and the transient frame and the selected samples are chosen based on a predetermined algorithm; and a transform coefficient combining block, for combining the M transient transform coefficients and the K further transform coefficients using a predetermined procedure, wherein the M+K combined transform coefficient are the M+K encoding values for the transient frame. Further, the at least one further frame may incorporate an ending part of the first frame and a beginning part of the transient frame based on the predetermined algorithm. Still further, the transform analysis may be a lapped transform analysis or a modified discrete cosine transform (MDCT) analysis.

Still further according to the fifth aspect of the invention, the M transform coefficients may correspond to a long transient window with a length of L samples, and the K further transform coefficients may correspond to a short transient window with a length of $L_s$ samples, and wherein L and $L_s$ may be pre-selected integers with L>M and $L_s$>K. Further, the long transient window may start from a first sample of the transient frame and may extend over a following frame, and optionally L=2M and $L_s$=2K. Still further, the combining the M transform coefficients and the K further transform coefficients based on the predetermined procedure may generate M+K transform coefficients X(j), wherein an index j=0, 1, . . . , M+K−1 and at least one of the transform coefficients X(M+i) is not equal to zero when a further index i is equal to 0, 1, . . . or K−1. Yet still further, electronic device may further comprise: a transform coefficient removing block, for setting the transform coefficients X(M+i) to zero, thus completing the encoding the transient frame; and means for sending all encoded frames including the transient frame for decoding.

According further to the fifth aspect of the invention, the electronic device may be an encoder, an electronic communication device, a mobile communication device or a mobile phone, or the electronic device contains an encoder.

According to a sixth aspect of the invention, an electronic device for decoding to a time domain a frame of an acoustic signal encoded using a transform based frequency domain codec with M+K transform coefficients X(j), wherein an index j=0, 1, . . . , M+K−1, and with last K coefficients X(M+i) with a further index i=0, 1, . . . or K−1 set to zero, comprises: a modification module, for modifying the M+K transform coefficients X(j) with the K transform coefficients set to zero by setting at least one of the last K transform coefficients X(M+i) to a non-zero value based on a predetermined criterion; and an inverse transform block, for performing an inverse transform of the M+K transform coefficients after the modifying, thus completing the decoding the frame of the acoustic signal to the time domain.

According further to the sixth aspect of the invention, the transform coefficients X(M+i) during the decoding may be calculated as follows:

$$X(M+i)=X(M-K+i) \text{ or}$$

$$X(M+i)=X(M-i-1).$$

Further according to the sixth aspect of the invention, the transform coefficients X(M+i) during the decoding may be chosen randomly with a normalized gain, or the transient transform coefficients X(M+i) during the decoding may be chosen using linear prediction based on other coefficients out of the transient transform coefficients X(j) using a further predetermined criterion.

Still further according to the sixth aspect of the invention, the electronic device may be a decoder, an electronic communication device, a mobile communication device or a mobile phone, or the electronic device may contain a decoder.

According to a seventh aspect of the invention, a system capable of encoding an acoustic signal, comprises: means for encoding a first frame of an acoustic signal using a first encoding method; and a transient encoder for encoding a transient frame of an acoustic signal which follows the first frame and contains M samples using a second encoding method for producing a set of M+K encoding values, wherein M and K are pre-selected integers of at least a value of one.

According further to the seventh aspect of the invention, a decision for using the first encoding method or the second encoding method may be made based on a pre-selected criterion.

Further according to the seventh aspect of the invention, the first encoding method may be a time domain codec, optionally a code excited linear prediction (CELP).

Still further according to the seventh aspect of the invention, the transient encoder for the encoding the transient frame may comprise: a long transform window block for performing a transform analysis of the transient frame for generating in a frequency domain M transient transform coefficients; a short transform window block, for performing the transform analysis of at least one further frame for generating in the frequency domain K further transform coefficients, wherein the further frame contains selected samples from both the first frame and the transient frame and the selected samples are chosen based on a predetermined algorithm; and a transform coefficient combining block, for combining the M transient transform coefficients and the K further transform coefficients using a predetermined procedure, wherein the M+K combined transform coefficient are the M+K encoding values for the transient frame. Further, the at least one further frame may incorporate an ending part of the first frame and a beginning part of the transient frame based on the predetermined algorithm. Still further, the transform analysis may be a lapped transform analysis or a modified discrete cosine transform (MDCT) analysis.

According further to the seventh aspect of the invention, the M transform coefficients may correspond to a long transient window with a length of L samples, and the K further transform coefficients may correspond to a short transient window with a length of $L_s$ samples, and wherein L and $L_s$ may be pre-selected integers with L>M and $L_s$>K. Further, the long transient window may start from a first sample of the transient frame and extend over a following frame, and optionally L=2M and $L_s$=2K. Still further, combining the M transform coefficients and the K further transform coefficients based on the predetermined procedure may generate M+K transform coefficients X(j), wherein an index j=0, 1, . . . , M+K−1 and at least one of the transform coefficients X(M+i) is not equal to zero when a further index i is equal to 0, 1, . . . or K−1. Further still, the system may comprise: a transform coefficient removing block, for setting the transform coefficients X(M+i) to zero, thus completing the encoding the transient frame; and means for sending all encoded frames including the transient frame for decoding.

According still further to the seventh aspect of the invention, the system may further comprise: means for receiving all encoded frames by a further electronic device; means for decoding the first frame in the time domain by the further electronic device, wherein the first encoding method is a time domain codec; and a transient decoder of the further electronic device, for decoding the encoded transient frame to the time domain using the non-zero first M transform coefficients in the frequency domain, thus compensating transient effects in transform coding. Further, the decoding of the encoded transient frame may be performed by using at least one of the transform coefficients X(M+i) set to a non-zero value based on a predetermined criterion by the further electronic device. Still further, the transform coefficients X(M+i) during the decoding may be calculated as follows:

$$X(M+i)=X(M-K+i) \text{ or}$$

$$X(M+i)=X(M-i-1).$$

Still further, the transform coefficients X(M+i) during the decoding may be chosen randomly with a normalized gain, or the transient transform coefficients X(M+i) during the decoding may be chosen using linear prediction based on other coefficients out of the transient transform coefficients X(j) using a further predetermined criterion.

According to the eighth aspect of the invention, a system, capable of decoding to a time domain a frame of an acoustic signal encoded using a transform based frequency domain codec with M+K transform coefficients X(j), wherein an index j=0, 1, . . . , M+K−1, and with last K coefficients X(M+i) with a further index i=0, 1, . . . or K−1 set to zero, comprises: a modification module, for modifying the M+K transform coefficients X(j) with the K transform coefficients set to zero by setting at least one of the last K transform coefficients X(M+i) to a non-zero value based on a predetermined criterion; and an inverse transform block, for performing an inverse transform of the M+K transform coefficients after the modifying, thus completing the decoding the frame of the acoustic signal to the time domain.

According further to the eighth aspect of the invention, the transform coefficients X(M+i) during the decoding may be calculated as follows:

$$X(M+i)=X(M-K+i) \text{ or}$$

$$X(M+i)=X(M-i-1).$$

Further according to the eighth aspect of the invention, the transform coefficients X(M+i) during the decoding may be chosen randomly with a normalized gain, or the transient transform coefficients X(M+i) during the decoding may be chosen using linear prediction based on other coefficients out of the transient transform coefficients X(j) using a further predetermined criterion.

Still further according to the eighth aspect of the invention, the frame of the acoustic signal may follow a first frame of the acoustic signal encoded using a first encoding method, and the frame may be a transient frame containing M samples and encoded using a second encoding method for producing a set of the M+K transform coefficients X(j), wherein M and K are pre-selected integers of at least a value of one. Further, a decision for using the first encoding method or the second encoding method may be made based on a pre-selected criterion. Still further, the first encoding method may be a time domain codec, optionally a code excited linear prediction (CELP).

According further to the eighth aspect of the invention, for facilitating the encoding of the transient frame, the system may further comprise: a long transform window block, for performing a transform analysis of the transient frame for generating in a frequency domain M transient transform coefficients; a short transform window block, for performing the transform analysis of at least one further frame for generating in the frequency domain K further transform coefficients, wherein the further frame contains selected samples from both the first frame and the transient frame and the selected samples are chosen based on a predetermined algorithm; and a transform coefficient combining block, for combining the M transient transform coefficients and the K further transform coefficients using a predetermined procedure, thus generating the M+K combined transform coefficient X(j). Further still, the at least one further frame may incorporate an ending part of the first frame and a beginning part of the transient frame based on the predetermined algorithm. Yet still further, the transform analysis may be a lapped transform analysis or a modified discrete cosine transform (MDCT) analysis.

According yet further still to the eighth aspect of the invention, the M transform coefficients may correspond to a long transient window with a length of L samples, and the K further transform coefficients may correspond to a short transient window with a length of $L_s$ samples, and wherein L and $L_s$ are pre-selected integers with L>M and $L_s$>K. Further, the long transient window may start from a first sample of the transient frame and extend over a following frame, and optionally L=2M and $L_s$=2K.

Yet still further according to the eighth aspect of the invention, the system may further comprise: a transform coefficient removing block, for setting the transform coefficients X(M+i) to zero, thus completing the encoding the transient frame; and means for sending all encoded frames including the transient frame for decoding. Further, the system may further comprise: means for receiving all encoded frames by a further electronic device; and means for decoding the first frame in the time domain by the further electronic device.

BRIEF DESCRIPTION OF THE DRAWINGS

For a better understanding of the nature and objects of the present invention, reference is made to the following detailed description taken in conjunction with the following drawings, in which.

BEST MODE FOR CARRYING OUT THE INVENTION

The present invention provides a method for compensating transient effects in transform coding (or equivalently called encoding) and decoding of a combined speech and audio in electronic devices by using a transform based time-frequency domain codec. For example, according to the present invention, the method can combine a CELP (code excited linear prediction) type speech codec and a transform type audio codec. The invention describes a compensation method to handle the transient, e.g., compensating the transient effect in transform coding when the number of quantized transform coding coefficients is lower than in the output of the transform.

The speech and audio codec of present invention applies a dual structure utilizing a conventional CELP structure for speech and transient signals and a modified discrete cosine transform (MDCT) for music and stationary signals. The present invention provides a solution to the transient, e.g., from the CELP coding to the transform coding. The reconstruction of the MDCT transform coding requires the overlapping contribution from the previous frame. Now, when changing from a CELP frame to a MDCT frame, there are no transform coefficients available from the previous frame. Therefore, a long transient windowing is required producing a higher number of transform coefficients that a normal overlapping window. The problem is that a fixed rate quantization cannot handle variable size transform coefficient vectors. Therefore, the transform coefficient vector is cut (set to zero) to accommodate the same number of coefficient to a typical overlapping window. Cutting the vector reduces the accuracy of the transform since a part of the information is lost. At the reconstruction phase, according to one embodiment of the present invention, the transient window is reproduced and the cut coefficients are replaced with zeros (if it is not set prior to sending by an encoding device) to keep the synthesized vector size correct. Naturally, part of the information is lost from the reconstructed signal.

According to the present invention, the solution is to compensate the coefficients set to zero using either random coefficients with a balanced (normalized) gain, i.e., the energy of a random signal is the same (or close) to the original signal, using spectral folding, i.e. copying the neighboring coefficients to the missing section or using linear prediction from the neighboring coefficients. The selection of the compensation method can be made based on the characteristics of the signal. For example, in case of a noisy signal, the random coefficients are sufficient, while the linear prediction works better with the periodic signals with a clear spectral structure.

Figure 1A:
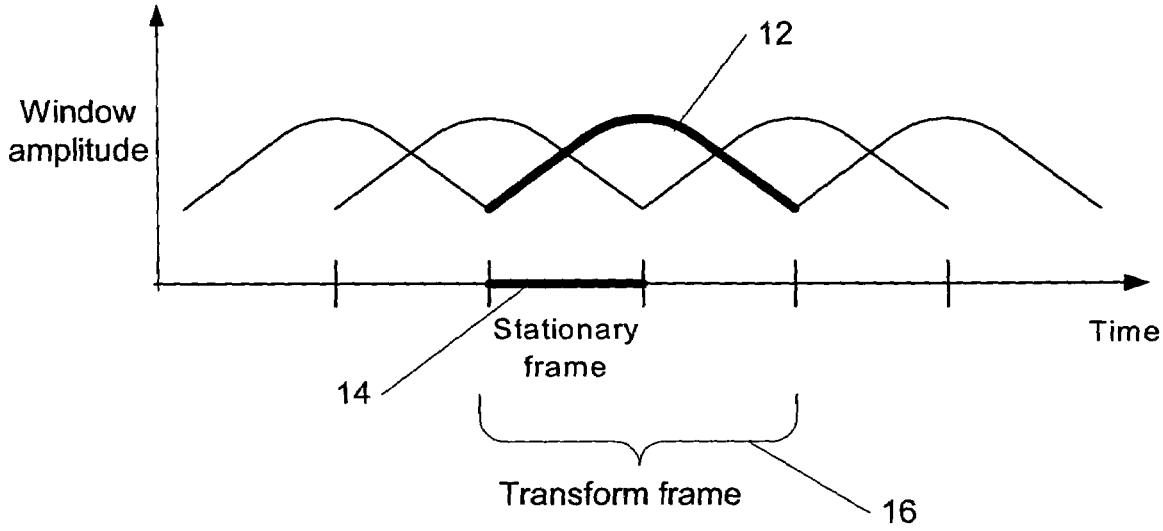
FIG. 1*a* is a plot demonstrating overlapped transform windowing.

A typical transform audio codec utilizes lapped transform algorithms to process the audio signal. FIG. 1*a* presents one example (among many other possible situations) of a 100% overlapping transform. Each analysis window 12 covers the analysis frame (e.g., a stationary frame 14) and the consecutive look-ahead frame (e.g., corresponding to a total transform frame 16). Hence, the transform is longer than the analysis frame. For example, when the analysis frame (e.g., a stationary frame 14) contains M=256 samples, the overlapping transform length is L=512 samples. Although the input signal length is 512, the number of output coefficients of the lapped transform is 256.

The lapped transform of input signal x can be obtained by $$X=P^T\bar{x}, \tag{1}$$

where $\bar{x}$ is a signal block having L input samples and expressed by $$\bar{x}=[x(mM-L+1)\ x(\mathrm{mM}-L+2)\ \ldots\ x(\mathrm{mM}-1)\ x(\mathrm{mM})]^T$$

wherein m is an index and M is a frame length. The equation 2 indicates that each sample can be used in several analysis blocks. In the FIG. 1 the overlapping is 100% and therefore L=2M. 100% overlapping means also that each analysis frame is used twice in the transform. The transform basis functions (e.g., a modified discrete cosine transform, MDCT) with the length L can be stored in a matrix $P^T$, which has the size M×L, i.e., M transform coefficients are produced from the input vector of the length L.

Figure 1B:
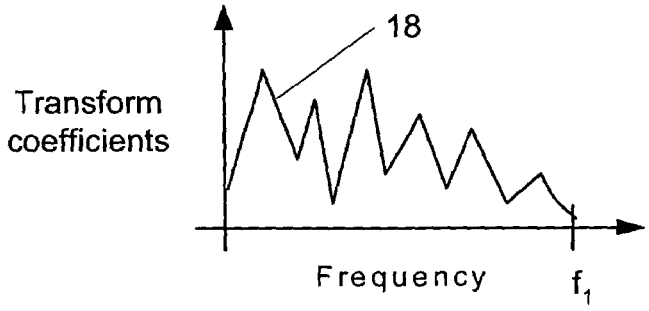
FIG. 1*b* is a plot of transform coefficients in a frequency domain of the overlapped transform windowing of FIG. 1*a;*

FIG. 1*b* is a plot of transform coefficients 18 in a frequency domain of the overlapped transform windowing of FIG. 1*a* for the stationary frame 14. FIG. 1*b* presents conceptually transform analysis window in the time domain and the corresponding transform coefficients in the frequency domain. As explained above, the number of transform coefficients depends on the analysis window size (frame size). When a constant transform is utilized, the number of coefficients for quantization is the same in each frame.

As FIG. 1*a* indicates, the overlapping transform coefficients of each analysis frame depend on the coefficient of the previous frame (i.e., the current frame information is used to encode the previous frame). That is, when the signal is reconstructed using an inverse transform, the contribution of the previous frame needs to be taken into account. The reconstructed signal is formed by the superposition of the overlapping transforms. The reconstructed signal is obtained by $$\bar{x}=PX, \tag{3}$$

wherein $\bar{x}$ is again a signal block of L=2M samples.

Adding the overlapping parts of the inverse transform coefficients together finally forms the reconstructed signal. The latter half of the previous inverse transform output is added to the first half of the current signal block. In the end, the reconstructed signal length is identical to that of the input signal.

Figure 6:
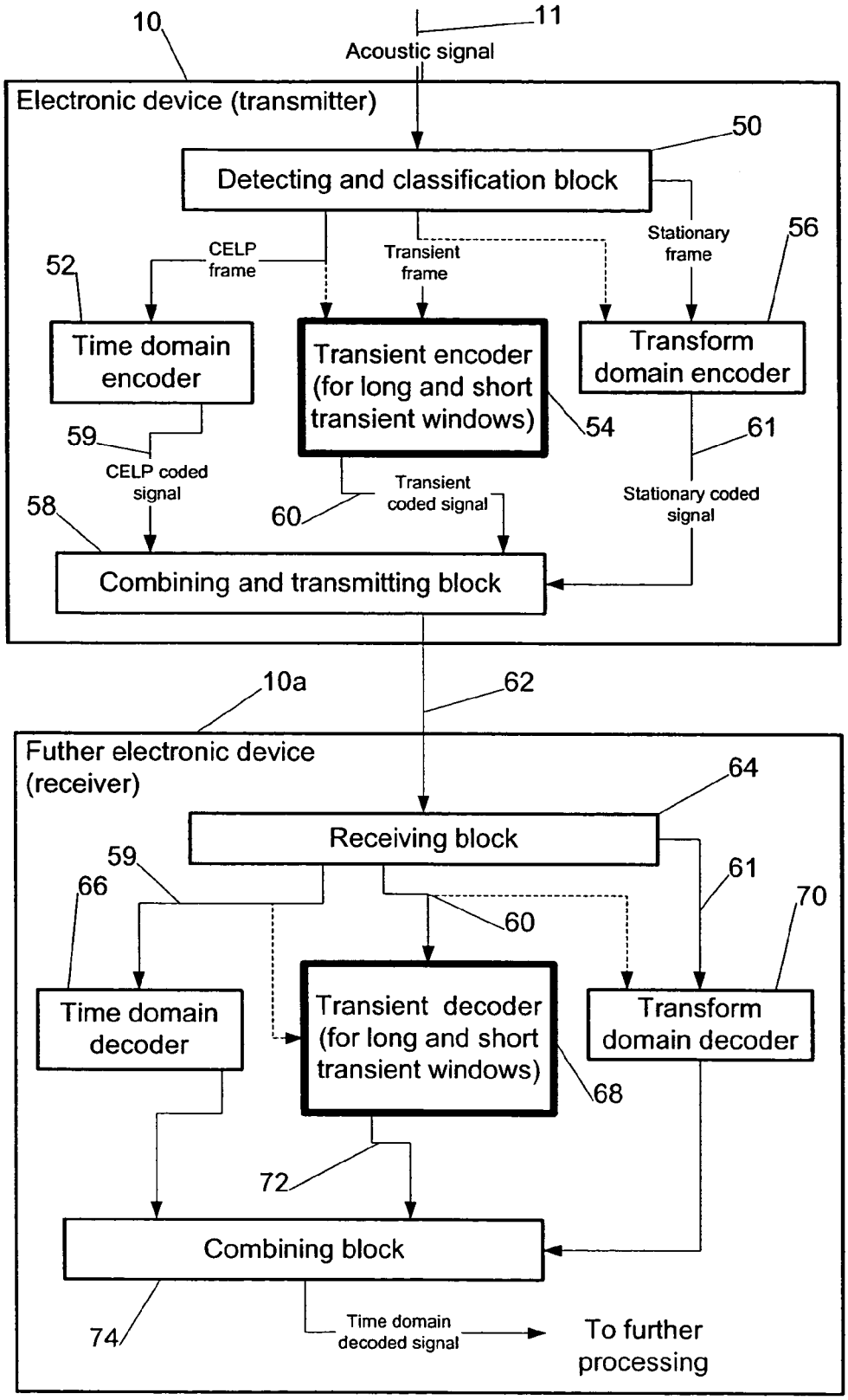
FIG. 6 is a block diagram of a system for compensating transient effects in transform coding and decoding in electronic devices by using a transform based time-frequency domain codec, according to the present invention.

Typically, the encoder contains the transform functionality (see FIG. 6 for more details). The transform coefficients are quantized and transmitted to the decoder in which the inverse transform is conducted.

However, as it is pointed out earlier, combining the time-domain coding algorithm with the overlapping transform codec described above causes problems which are resolved by the present invention.

Figure 2A:
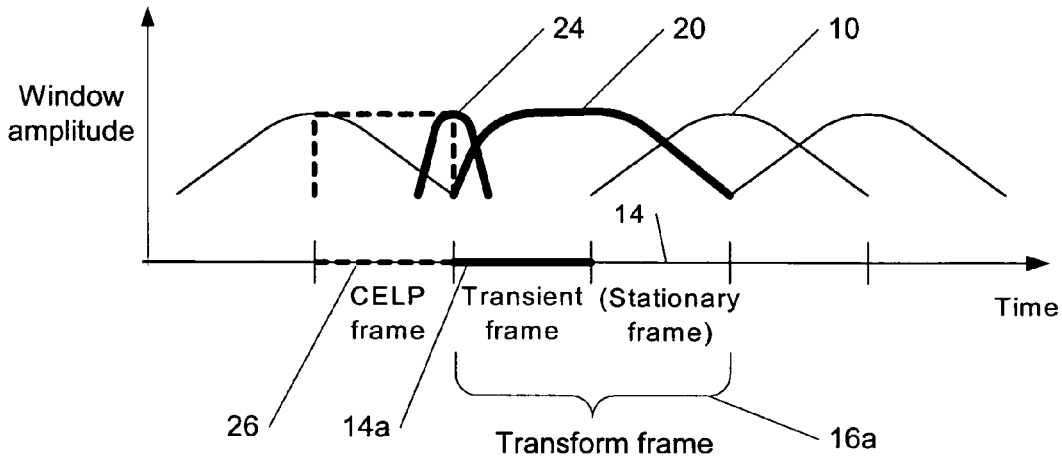
FIG. 2*a* is a plot demonstrating a transient windowing method when transform coding is combined with a time domain CELP coding, according to the present invention.

FIG. 2*a* is an example, among others, showing a plot demonstrating a transient windowing method when transform coding is combined with a time domain CELP coding, according to the present invention.

FIG. 2*a* presents the condition when the previous frame, a CELP frame 26, was encoded with a CELP (or a time domain) encoder without any overlapping functionality and the codec changes to a transform coding in the current frame, a transient frame 14*a*. The decision of this codec change is based on a pre-selected criterion (e.g., based on spectral content of the frame). The problem is that the current frame does not have the overlapping window from the previous frame and the signal reconstruction cannot be done in a similar manner (overlap-add method) as in the pure transform coding.

Figure 2B:
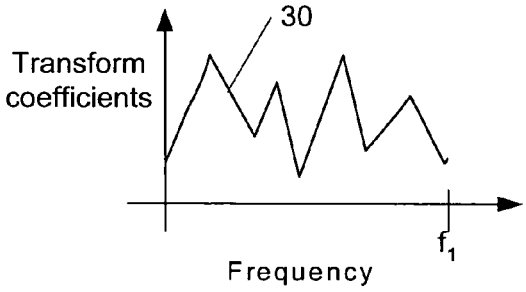
FIG. 2*b* is a plot of transform coefficients in a frequency domain of a short transient window of FIG. 2*a,* according to the present invention.
Figure 2C:
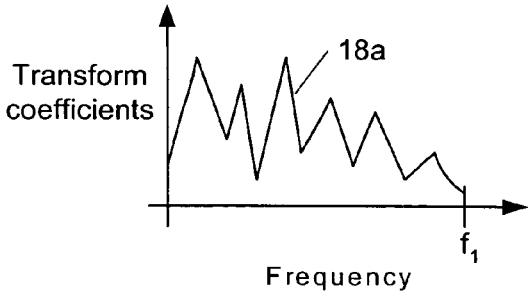
FIG. 2*c* is a plot of transform coefficients in a frequency domain of a long transient window of FIG. 2*a,* according to the present invention.

According to the present invention, the solution is to use a long transient window 20 in the transform for generating in a frequency domain M transform coefficients 18*a* (see FIG. 2*c* discussed below). FIG. 2*a* presents an example of such an approach. The long transient window 20 is non-symmetric and tries to cover the full transform frame 16*a*. Typically, the long transient window 20 starts from a first sample of said transient frame 14*a* and extends over a following frame as shown in FIG. 2*a*. The sample number M and the transform length L, according to the present invention, can be pre-selected to be the same as in the case of said transform analysis of the stationary frame 14 (see FIG. 1*a*), but generally they can be different, i.e., the sample number for this long transient window 20 can be M' which is larger than M and, therefore, M' (larger than M) transform coefficients can be generated for said long transient window 20 and to be used for encoding the transient frame 14*a*. This encoding solution represents only one embodiment of the present invention, wherein a decoding procedure of the transient frame 14*a* encoded with M' transform coefficients (similar to having M+K transform coefficients) is described below, according to the present invention.

Furthermore, according to the present invention, a short transient window 24 containing K samples (K is a pre-selected integer) for generating in a frequency domain K transform coefficients 30 (see FIG. 2*b* discussed below) can be also introduced in the frame 14*a* boundary with the CELP frame 26 to improve the transient performance based on a predetermined algorithm, e.g., by incorporating the ending part of the CELP frame 26 and a beginning part of said transient frame 14*a* base on a pre-selected criterion (which, e.g., determines the length K). The number of short windows can naturally be higher than one, according to the present invention. By this method a short overlapping transform is introduced in the transient frame 14*a* as explained in more detail below. The disadvantage of this method is the increased number of transform coefficients.

It is noted that the transient from the transform coding to the CELP coding is more straightforward, i.e., the signal reconstruction in a frame before CELP is not affected because there is no need for overlapping information with the CELP frame, and therefore, the transient is smooth.

As it was pointed out above, when a constant transform is utilized, the number of coefficients for quantization stays the same in each frame. However, in the transient frame 14*a* presented in FIG. 2*a*, this number is changed. FIGS. 2*b* and 2*c* illustrate the concept. The output of the transient transform is two sets of coefficients. First, there is the output of the short transient window 24, and secondly there is the output of the non-symmetric long transient window 20. FIG. 2*b* is an example among others of a plot of the transform coefficients 30 in the frequency domain of a short transient window 24 of FIG. 2*a*. FIG. 2*c* is an example among others of a plot of the transform coefficients 18*a* in the frequency domain of the long transient window 20 of FIG. 2*a*.

Since both sets of the coefficients represent the full frequency range, the short and long coefficients are combined into one vector using a predetermined procedure, according to the present invention, i.e., the first set of the coefficients 30 can be embedded into the second set of the coefficients 18*a* so that the corresponding frequency bins are in correct places. The outcome is that the number of coefficients is increased, e.g., by half of the short transient window 24 compared to a regular frame (e.g., the same length frames 14 or 14*a*). When the non-symmetric long transient window 20 has the same length as a traditional overlapping window, then L=2M and the short transient window (corresponding to a short transient frame with K samples) has the length $L_{short}$=2K, and the total number of coefficients in the combined transient frame is M+K, i.e., the combined vector length becomes M+K.

The problem, however, arises in quantization. A fixed rate quantization is designed for a certain number of input samples or fixed size input vectors. Even if the quantization accepts variable size input vectors, the quantization accuracy may be worse than the fixed size quantization, unless the bit rate is increased. A solution to the problem is to limit the bandwidth of the transient frame 14*a*.

Figure 3:
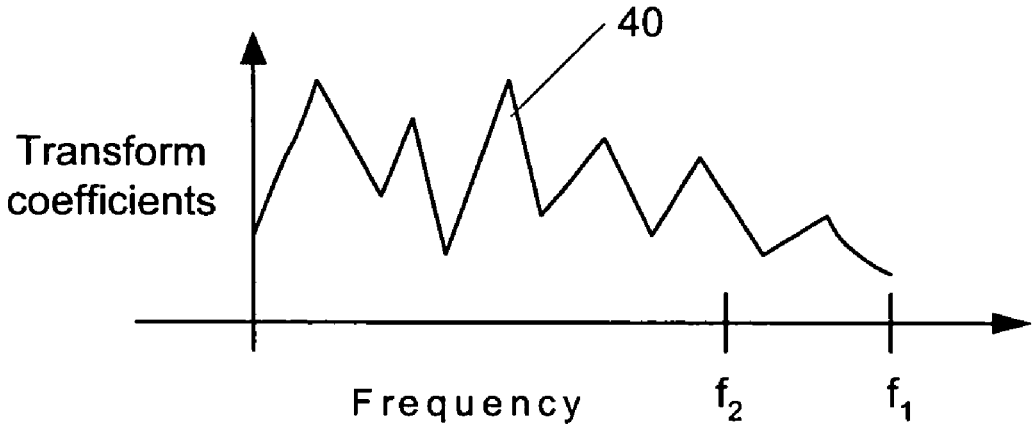
FIG. 3 is a plot of combined transform coefficients in a frequency domain of short and long transient windows of FIG. 2*a,* according to the present invention.
Figure 4:
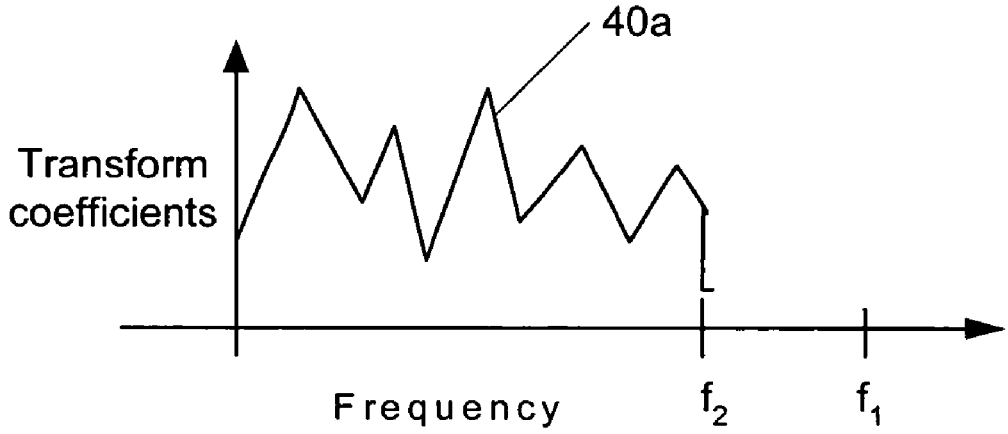
FIG. 4 is a plot of combined transform coefficients in a frequency domain of short and long transient windows of FIG. 2*a* with a band limitation when high frequency components are set to zero, according to the present invention.

FIGS. 3 and 4 illustrate the concept described above. FIG. 3 shows an example, among others, of a plot of the transient transform coefficients 40 in a frequency domain of the combined transform coefficients 30 and 18*a* of the short and long transient windows 24 and 20, respectively, of FIG. 2*a*, according to the present invention. The total number of the coefficients of FIG. 3 is M+K as explained above. A frequency $f_2$ corresponds to the Mth coefficient.

FIG. 4 shows a plot of combined transient transform coefficients 40*a* with a band limitation when high frequency coefficients of the transient transform coefficients 40 of FIG. 3 are set to zero, according to the present invention. The number of non-zero transform coefficients 40*a* is M as for the analysis window 12 of FIG. 1*a*. Thus, a number of high frequency transform coefficients of the combined output vector of the combined transform coefficients 30 and 18*a* are set to zero and are not quantized at all. The short window length determines the number of coefficients set to zero.

FIG. 4 presents the band limited transform coefficients in frequency domain, such that $$X(M+i)=0 \text{ for } i=0 \ldots K-1,$$

wherein M is the number of transform coefficients in the quantization and in the overlapped transform. M+K is the number of transient transform coefficients in the transient frame 14*a*, when the short transient window length is 2K as it was mentioned above. For the case shown in FIG. 4, the quantization of the reduced set of the transform coefficients can be done in a similar manner as for a typical transform vector. The decoder receives information about the change in the coding algorithm and decodes a transient frame (with high frequency transform coefficients can be set to zero prior to be received by the encoder) by splitting the vector for short and non-symmetric (long) inverse transforms. This method, if used, will enable the usage of the fixed size and fixed rate quantization designed for the conventional transform coding but with significant limitations, i.e., the disadvantage is that the audio bandwidth is limited in the transient frames which may lead to audible artifacts in the reconstructed signal.

Figure 5:
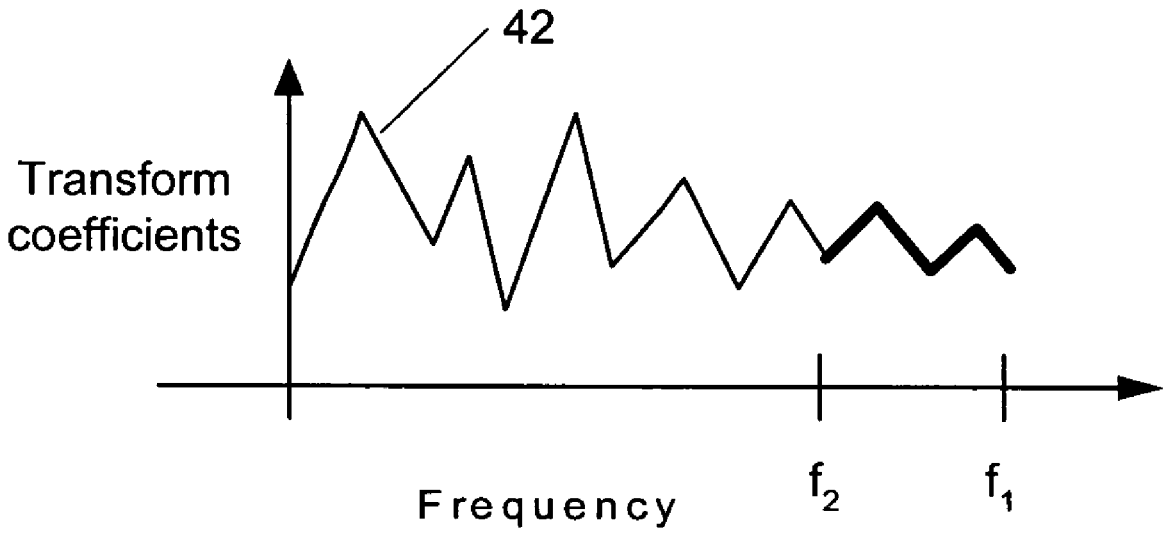
FIG. 5 is a plot of combined transform coefficients in a frequency domain of short and long transient windows of FIG. 2*a* with a band limitation compensation when high frequency components have non-zero values using copying from lower frequencies, according to the present invention.

The present invention presents a method for compensating the band limitation described above. The high frequency components of the transient frame set to zero (as shown in FIG. 4) after encoding are replaced by non-zero components during the decoding (e.g., as shown in FIG. 5) based on a predetermined criterion. According to the present invention, there is a number of alternative procedures for replacing the high frequency transform coefficients, e.g., to copy the coefficients from a lower band, take a mirror image or use a random variable approach (artificial noise). In all cases the added coefficients need to be scaled with a proper gain factor.

FIG. 5 shows one example among many others of a plot of combined transform coefficients 42 in a frequency domain of the short and long transient windows of FIG. 2*a* with a band limitation compensation when the high frequency coefficients have non-zero values and these high frequency coefficients are copied from lower frequencies, according to the present invention. The copied transient transform coefficients during the decoding are calculated as follows:

$$X(M+i)=X(M-K+i),\ i=0 \ldots K-1.$$

According to the present invention, the mirroring of the coefficients can be implemented when said transient transform coefficients X(M+i) are calculated during said decoding as follows:

$$X(M+i)=X(M-i-1),\ i=0\ldots K-1.$$

The selection on whether to copy the coefficients from low band or to set random values can be made based on the input signal characteristics.

Also, according to the present invention, the transient transform coefficients X(M+i) during said decoding can be chosen randomly with a normalized (balanced) gain (this means that the random signal with the balanced gain has the same or close energy as the original signal). Furthermore, the transient transform coefficients X(M+i) during said decoding can be chosen using linear prediction based on other coefficients out of the transient transform coefficients X(j) based on a pre-selected criterion.

FIG. 6 shows one example, among many others, of a block diagram of a system for compensating transient effects in transform coding and decoding in an electronic device 10 and in a further electronic device 10*a*, respectively, by using a transform based time-frequency domain codec, according to the present invention. As shown in FIG. 6, the device 10 acts as an encoder and a transmitter and the device 10*a* acts as a decoder and a receiver. According to the present invention each of the electronic devices 10 and 10*a* can have both encoding (plus transmitting) and decoding (plus receiving) capabilities.

In the example of FIG. 6, a detecting and classification block 50 of the device 10 receives an acoustic signal 11, converts the acoustic signal 11 into electrical acoustic signal and provides a classification of the acoustic signal 11 frame-by-frame based on a predetermined classification criterion (e.g., speech vs. music, etc. as described above). Thus, each frame of the electrical acoustic signal based on the classification is sent to an appropriate encoder: the CELP frame (e.g., see the CELP frame 26 in FIG. 2*a*) is provided to a time domain encoder 52 which generates a CELP coded signal 59 in the time domain; the stationary frame (e.g., see the stationary frame 14 in FIG. 1*a*) is provided to a transform domain encoder 56 which generates a stationary coded signal 61 (e.g., using the MDCT algorithm and containing the transform coefficients 18 as shown in FIG. 1*b*); and the transient frame (e.g., see the transient frame 14*a* in FIG. 2*a*) is provided to a transient encoder 54 which generates a transient coded signal 66, e.g., containing the transient transform coefficients 40*a* shown in FIG. 4 by setting the last K coefficients to zero as described above.

As it was described above, the inventive step is to use transient compensation when the previous frame was encoded with the time domain encoder and the current frame is classified as a frame that needs the transform domain encoding (e.g., the frame 14*a*). The transient encoder 54 utilizes the short transient window 24 (covering partly the end of the previous frame 26 and the beginning part of said transient frame 14*a* based on a pre-selected criterion) and the long transient window 20 overlapping to the next frame (similarly to regular analysis window 12). The transient transform domain encoding block 54 provides the transform coefficients similar to those generated by the regular transform domain encoding block 56, but instead of providing M+K coefficients (corresponding to the short and to the long transient windows, e.g., as shown in FIG. 3), the last K coefficients are removed (set to zero) and only M first coefficients are transmitted. The signals 59, 60 and 61 are combined by a combining and transmitting block 58 and transmitted (a signal 62) with an appropriate identification to the further electronic device 10*a*.

A receiving block 64 of the further electronic device (receiver) 10*a* directs the appropriate coded signals (based on said identification) to corresponding decoding blocks: the CELP coded signal 59 to a time domain decoder 66, the stationary coded signal 61 to a transform domain decoder 70 and the transient coded signal 60 to a transient transform decoder 68. For the time domain (the block 66) there is a CELP type of decoding algorithm and for the transform domain (the block 70) there is a transform domain decoding algorithm, which are well known in the art. However, the performance of the transient transform domain decoder 68 is novel: it receives a bit stream, decodes M transform coefficients and compensates the transient by generating the missing K transform coefficients at the end of the vector based on a predetermined criterion, according to the present invention, as described above. All three decoders reconstruct the appropriate frames of the original acoustic signal 11 in the time domain which are after combining by a combining block 74 are sent to further processing. Most of the blocks shown in FIG. 6 except the blocks 54 and 68 are well known in the art. The blocks 54 and 68 are discussed in more details below.

Figure 7A:
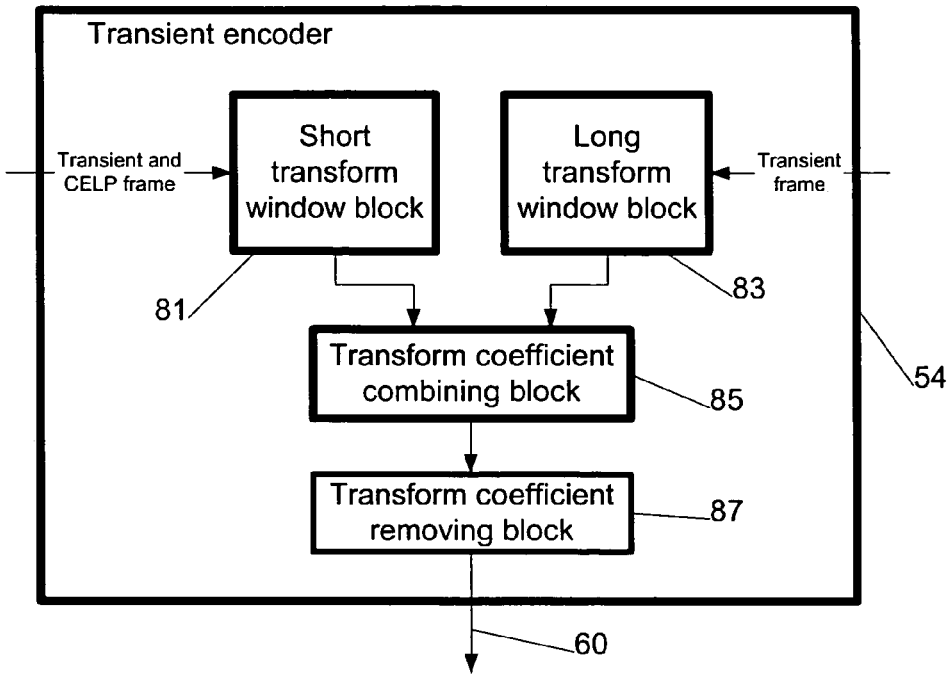
FIG. 7*a* is a block diagram of a transient encoder, according to the present invention.

FIG. 7*a* shows one example, among many other possible scenarios, for implementing the transient encoder 54, according to the present invention. The transient encoder 54 comprises a short transform window block 81 for generating K transform coefficients 30 and a long transform window block 83 for generating M transform coefficients 18*a* as discussed above (see FIGS. 2*a*, 2*b* and 2*c*). The transient encoder 54 further comprises a transform coefficient combining block 85 for combining M and L transform coefficients to form M+K transient transform coefficients; and a transform coefficient removing block 87 for setting the last K coefficients of the combined M+K transient transform coefficients to zero.

Figure 7B:
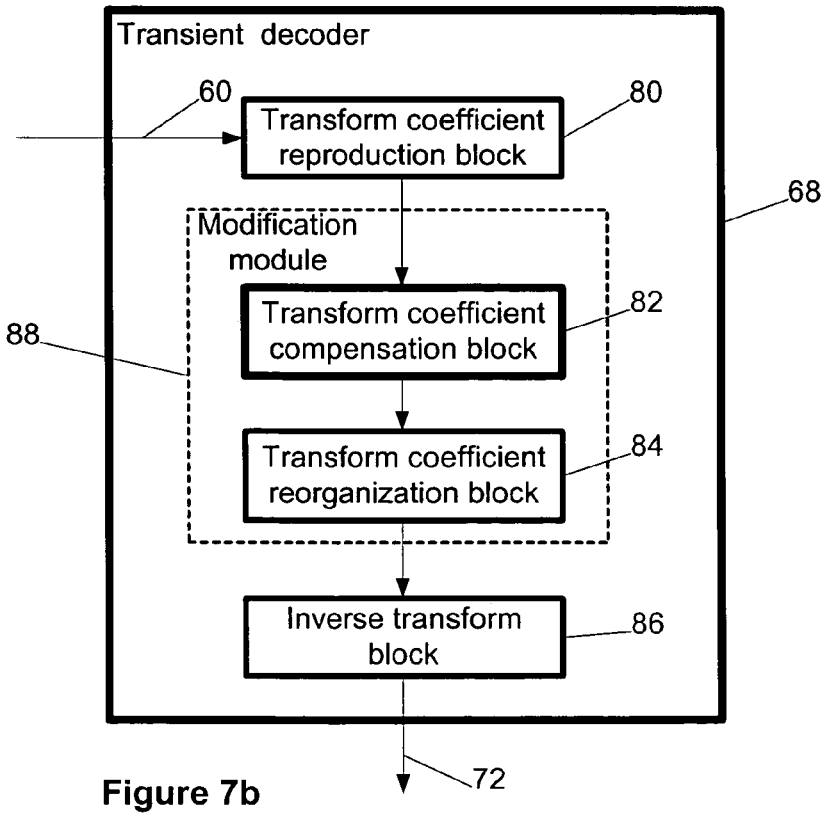
FIG. 7*b* is a block diagram of a transient transform domain decoder, according to the present invention.

FIG. 7*b* shows one example, among many other possible scenarios, for implementing the transient transform domain decoder 68, according to the present invention. The transient transform domain decoder 68 comprises a transform coefficient reproduction block 80, i.e., a decoding means to reproduce M transform coefficients; a modification module 88 comprising a transform coefficient compensation block 82, i.e., means to compensate the missing K coefficients and a transform coefficient reorganization block 84, i.e. the means for reorganizing the coefficients into K short transient and M long transient transform coefficients; and an inverse transform block 86, i.e., the means to inverse transform the two sets into a time domain signal.

It is to be understood that the above-described arrangements are only illustrative of the application of the principles of the present invention. Numerous modifications and alternative arrangements may be devised by those skilled in the art without departing from the scope of the present invention, and the appended claims are intended to cover such modifications and arrangements.

What is claimed is:

1. A method for encoding an acoustic signal, comprising:

encoding a first frame of the acoustic signal using a first encoding method; and encoding a transient frame of the acoustic signal which follows said first frame and contains M samples using a second encoding method for producing a set of M+K encoding values, wherein M and K are pre-selected integers of at least a value of one.

2. The method of claim 1, wherein a decision for using said first encoding method or said second encoding method is made based on a pre-selected criterion.

3. The method of claim 1, wherein said first encoding method is a time domain codec, or a code excited linear prediction.

4. The method of claim 1, wherein the step of said encoding said transient frame comprises:

performing a transform analysis of said transient frame for generating in a frequency domain M transient transform coefficients;

performing said transform analysis of at least one further frame for generating in the frequency domain K further transform coefficients, wherein said further frame contains selected samples from both the first frame and the transient frame and said selected samples are chosen based on a predetermined algorithm; and combining said M transient transform coefficients and said K further transform coefficients using a predetermined procedure, wherein said M+K combined transform coefficient are said M+K encoding values for said transient frame.

5. The method of claim 4, wherein said at least one further frame comprises an ending part of said first frame and a beginning part of said transient frame based on said predetermined algorithm.

6. The method of claim 4, wherein said M transform coefficients correspond to a long transient window with a length of L samples, and said K further transform coefficients correspond to a short transient window with a length of $L_s$ samples, and wherein L and $L_s$ are pre-selected integers with L>M and $L_s$>K.

7. The method of claim 6, wherein said long transient window starts from a first sample of said transient frame and extends over a following frame, and optionally L=2M and $L_s$=2K.

8. The method of claim 4, wherein said transform analysis is a lapped transform analysis or a modified discrete cosine transform analysis.

9. The method of claim 4, wherein said combining said M transform coefficients and said K further transform coefficients based on said predetermined procedure generates M+K transform coefficients X(j), wherein an index j=0, 1, . . . , M+K−1 and at least one of said transform coefficients X(M+i) is not equal to zero when a further index i is equal to 0, 1, . . . or K−1.

10. The method of claim 9, further comprising:

setting said transform coefficients X(M+i) to zero, for completing said encoding said transient frame; and sending all encoded frames including said transient frame for decoding.

11. The method of claim 10, wherein the method of claim 10 is performed by an electronic device, the method further comprises:

receiving all encoded frames by a further electronic device;

decoding said first frame in the time domain by said further electronic device, wherein said first encoding method is a time domain codec; and decoding by said further electronic device said encoded transient frame to said time domain using said non-zero first M transform coefficients in the frequency domain, for compensating transient effects in transform coding.

12. The method of claim 11, wherein said decoding of said encoded transient frame is performed by using at least one of said transform coefficients X(M+i) set to a non-zero value based on a predetermined criterion by said further electronic device.

13. The method of claim 12, wherein said transform coefficients X(M+i) during said decoding are calculated as follows:

$$X(M+i)=X(M-K+i) \text{ or}$$

$$X(M+i)=X(M-i-1).$$

14. The method of claim 12, wherein said transform coefficients X(M+i) during said decoding are chosen randomly with a normalized gain, or said transient transform coefficients X(M+i) during said decoding are chosen using linear prediction based on other coefficients out of said transient transform coefficients X(j) using a further predetermined criterion.

15. The method of claim 11, wherein said electronic device is an encoder, an electronic communication device, a mobile communication device or a mobile phone, or said electronic device contains an encoder or a combination of said encoder and a decoder.

16. The method of claim 11, wherein said further electronic device is a decoder, an electronic communication device, a mobile communication device or a mobile phone, or said electronic device contains a decoder or a combination of said decoder and an encoder.

17. A computer program product comprising: a computer readable storage structure embodying computer program code thereon for execution by a computer processor with said computer program code, wherein said computer program code comprise instructions for performing the method of claim 1.

18. A method for decoding to a time domain a frame of an acoustic signal encoded using a transform based frequency domain codec with M+K transform coefficients X(j), wherein an index j=0, 1, . . . , M+K−1, and with last K coefficients X(M+i) with a further index i=0, 1, . . . or K−1 set to zero, comprising:

modifying said M+K transform coefficients X(j) with said K transform coefficients set to zero by setting at least one of said last K transform coefficients X(M+i) to a non-zero value based on a predetermined criterion; and performing an inverse transform of said M+K transform coefficients after said modifying, for completing said decoding said frame of said acoustic signal to said time domain.

19. The method of claim 18, wherein said transform coefficients X(M+i) during said decoding are calculated as follows:

$$X(M+i)=X(M-K+i) \text{ or}$$

$$X(M+i)=X(M-i-1).$$

20. The method of claim 18, wherein said transform coefficients X(M+i) during said decoding are chosen randomly with a normalized gain, or said transient transform coefficients X(M+i) during said decoding are chosen using linear prediction based on other coefficients out of said transient transform coefficients X(j) using a further predetermined criterion.

21. The method of claim 18, wherein said frame of said acoustic signal follows a first frame of said acoustic signal encoded using a first encoding method, and said frame is a transient frame containing M samples and encoded using a second encoding method for producing a set of said M+K transform coefficients X(j), wherein M and K are pre-selected integers of at least a value of one.

22. The method of claim 21, wherein a decision for using said first encoding method or said second encoding method is made based on a pre-selected criterion.

23. The method of claim 21, wherein said first encoding method is a time domain codec, or a code excited linear prediction.

24. The method of claim 21, wherein said encoding said transient frame comprises:

performing a transform analysis of said transient frame for generating in a frequency domain M transient transform coefficients;

performing said transform analysis of at least one further frame for generating in the frequency domain K further transform coefficients, wherein said further frame contains selected samples from both the first frame and the transient frame and said selected samples are chosen based on a predetermined algorithm; and combining said M transient transform coefficients and said K further transform coefficients using a predetermined procedure, for generating said M+K combined transform coefficient X(j).

25. The method of claim 24, wherein said at least one further frame comprises an ending part of said first frame and a beginning part of said transient frame based on said predetermined algorithm.

26. The method of claim 24, wherein said M transform coefficients correspond to a long transient window with a length of L samples, and said K further transform coefficients correspond to a short transient window with a length of $L_s$ samples, and wherein L and $L_s$ are pre-selected integers with L>M and $L_s$>K.

27. The method of claim 26, wherein said long transient window starts from a first sample of said transient frame and extends over a following frame, and optionally L=2M and $L_s$=2K.

28. The method of claim 24, wherein said transform analysis is a lapped transform analysis or a modified discrete cosine transform analysis.

29. The method of claim 24, wherein before decoding said transient frame, the method further comprises:

setting said transform coefficients X(M+i) to zero, for completing said encoding said transient frame; and sending all encoded frames including said transient frame for decoding.

30. The method of claim 29, wherein encoding of said acoustic signal is performed by an electronic device, and before decoding said transient frame, the method further comprises:

receiving all encoded frames by a further electronic device; and decoding said first frame in the time domain by said further electronic device, wherein said modifying said M+K transform coefficients X(j) and said performing said inverse transform of said M+K transform coefficients is also performed by said further electronic device.

31. The method of claim 30, wherein said electronic device is an encoder, an electronic communication device, a mobile communication device or a mobile phone, or said electronic device contains an encoder or a combination of said encoder and a decoder.

32. The method of claim 30, wherein said further electronic device is a decoder, an electronic communication device, a mobile communication device or a mobile phone, or said electronic device contains a decoder or a combination of said decoder and an encoder.

33. A computer program product comprising: a computer readable storage structure embodying computer program code thereon for execution by a computer processor with said computer program code, wherein said computer program code comprises instructions for performing the method of claim 18.

34. An electronic device for encoding an acoustic signal, comprising:

an encoder, for encoding a first frame of the acoustic signal using a first encoding method; and a transient encoder for encoding a transient frame of an acoustic signal which follows said first frame and contains M samples using a second encoding method for producing a set of M+K encoding values, wherein M and K are pre-selected integers of at least a value of one.

35. The electronic device of claim 34, wherein said electronic device is configured to make a decision for using said first encoding method or said second encoding method based on a pre-selected criterion.

36. The electronic device of claim 34, wherein said first encoding method is a time domain codec, or a code excited linear prediction.

37. The electronic device of claim 34, wherein the transient encoder for the encoding said transient frame comprises:

a long transform window block, for performing a transform analysis of said transient frame for generating in a frequency domain M transient transform coefficients;

a short transform window block, for performing said transform analysis of at least one further frame for generating in the frequency domain K further transform coefficients, wherein said further frame contains selected samples from both the first frame and the transient frame and said selected samples are chosen based on a predetermined algorithm; and a transform coefficient combining block, for combining said M transient transform coefficients and said K further transform coefficients using a predetermined procedure, wherein said M+K combined transform coefficient are said M+K encoding values for said transient frame.

38. The electronic device of claim 37, wherein said at least one further frame comprises an ending part of said first frame and a beginning part of said transient frame based on said predetermined algorithm.

39. The electronic device of claim 37, wherein said M transform coefficients correspond to a long transient window with a length of L samples, and said K further transform coefficients correspond to a short transient window with a length of $L_s$ samples, and wherein L and $L_s$ are pre-selected integers with L>M and $L_s$>K.

40. The electronic device of claim 39, wherein said long transient window starts from a first sample of said transient frame and extends over a following frame, and optionally L=2M and $L_s$=2K.

41. The electronic device of claim 37, wherein said transform analysis is a lapped transform analysis or a modified discrete cosine transform analysis.

42. The electronic device of claim 37, wherein said transform coefficient combining block is configured to combine said M transform coefficients and said K further transform coefficients based on said predetermined procedure by generating M+K transform coefficients X(j), wherein an index j=0, 1, . . . , M+K−1 and at least one of said transform coefficients X(M+i) is not equal to zero when a further index i is equal to 0, 1, . . . or K−1.

43. The electronic device of claim 42, further comprising:

a transform coefficient removing block, for setting said transform coefficients X(M+i) to zero, for completing said encoding said transient frame; and a transmitting block for sending all encoded frames including said transient frame for decoding.

44. The electronic device of claim 34, wherein said electronic device is an encoder, an electronic communication device, a mobile communication device or a mobile phone, or said electronic device contains an encoder.

45. An electronic device for decoding to a time domain a frame of an acoustic signal encoded using a transform based frequency domain codec with M+K transform coefficients X(j), wherein an index j=0, 1, . . . , M+K−1, and with last K coefficients X(M+i) with a further index i=0, 1, . . . or K−1 set to zero, comprising:

a modification module, for modifying said M+K transform coefficients X(j) with said K transform coefficients set to zero by setting at least one of said last K transform coefficients X(M+i) to a non-zero value based on a predetermined criterion; and an inverse transform block, for performing an inverse transform of said M+K transform coefficients after said modifying, for completing said decoding said frame of said acoustic signal to said time domain.

46. The electronic device of claim 45, wherein said transform coefficients X(M+i) during said decoding are calculated as follows:

$$X(M+i)=X(M-K+i) \text{ or}$$

$$X(M+i)=X(M-i-1).$$

47. The electronic device of claim 45, wherein said modification module is configured to choose transform coefficients X(M+i) during said decoding randomly with a normalized gain, or to choose said transient transform coefficients X(M+i) during said decoding using linear prediction based on other coefficients out of said transient transform coefficients X(j) using a fu rther predetermined criterion.

48. The electronic device of claim 45, wherein said electronic device is a decoder, an electronic communication device, a mobile communication device or a mobile phone, or said electronic device contains a decoder.

49. A system configured for encoding an acoustic signal, comprising:

an encoder, for encoding a first frame of an acoustic signal using a first encoding method; and a transient encoder for encoding a transient frame of an acoustic signal which follows said first frame and contains M samples using a second encoding method for producing a set of M+K encoding values, wherein M and K are pre-selected integers of at least a value of one.

50. The system of claim 49, wherein a decision for using said first encoding method or said second encoding method is made based on a pre-selected criterion.

51. The system of claim 49, wherein said first encoding method is a time domain codec, or a code excited linear prediction.

52. The system of claim 49, wherein said transient encoder for said encoding said transient frame comprises:

a long transform window block for performing a transform analysis of said transient frame for generating in a frequency domain M transient transform coefficients;

a short transform window block, for performing said transform analysis of at least one further frame for generating in the frequency domain K further transform coefficients, wherein said further frame contains selected samples from both the first frame and the transient frame and said selected samples are chosen based on a predetermined algorithm; and a transform coefficient combining block, for combining said M transient transform coefficients and said K further transform coefficients using a predetermined procedure, wherein said M+K combined transform coefficient are said M+K encoding values for said transient frame.

53. The system of claim 52, wherein said at least one further frame comprises an ending part of said first frame and a beginning part of said transient frame based on said predetermined algorithm.

54. The system of claim 52, wherein said M transform coefficients correspond to a long transient window with a length of L samples, and said K further transform coefficients correspond to a short transient window with a length of $L_s$ samples, and wherein L and $L_s$ are pre-selected integers with L>M and $L_s$>K.

55. The system of claim 54, wherein said long transient window starts from a first sample of said transient frame and extends over a following frame, and optionally L=2M and $L_s$=2K.

56. The system of claim 52, wherein said transform analysis is a lapped transform analysis or a modified discrete cosine transform analysis.

57. The system of claim 52, wherein transform coefficient combining block is configured to combine said M transform coefficients and said K further transform coefficients based on said predetermined procedure by generating M+K transform coefficients X(j), wherein an index j=0, 1, . . . , M+K−1 and at least one of said transform coefficients X(M+i) is not equal to zero when a further index i is equal to 0, 1, . . . or K−1.

58. The system of claim 57, further comprising:

a transform coefficient removing block, for setting said transform coefficients X(M+i) to zero, for completing said encoding said transient frame; and a transmitting block for sending all encoded frames including said transient frame for decoding.

59. The system of claim 58, further comprises:

a receiving block for receiving all encoded frames by a further electronic device;

a decoder for decoding said first frame in the time domain by said further electronic device, wherein said first encoding method is a time domain codec; and a transient decoder of said further electronic device, for decoding said encoded transient frame to said time domain using said non-zero first M transform coefficients in the frequency domain, for compensating transient effects in transform coding.

60. The system of claim 59, wherein said decoding of said encoded transient frame is performed by using at least one of said transform coefficients X(M+i) set to a non-zero value based on a predetermined criterion by said further electronic device.

61. The system of claim 60, wherein said transform coefficients X(M+i) during said decoding are calculated as follows:

$$X(M+i)=X(M-K+i) \text{ or}$$

$$X(M+i)=X(M-i-1).$$

62. The system of claim 60, wherein said transform coefficients X(M+i) during said decoding are chosen randomly with a normalized gain, or said transient transform coefficients X(M+i) during said decoding are chosen using linear prediction based on other coefficients out of said transient transform coefficients X(j) using a further predetermined criterion.

63. A system, configured for decoding to a time domain a frame of an acoustic signal encoded using a transform based frequency domain codec with M+K transform coefficients X(j), wherein an index j=0, 1, . . . , M+K−1, and with last K coefficients X(M+i) with a further index i=0, 1, . . . or K−1 set to zero, comprising:

a modification module, for modifying said M+K transform coefficients X(j) with said K transform coefficients set to zero by setting at least one of said last K transform coefficients X(M+i) to a non-zero value based on a predetermined criterion; and an inverse transform block, for performing an inverse transform of said M+K transform coefficients after said modifying, for completing said decoding said frame of said acoustic signal to said time domain.

64. The system of claim 63, wherein said transform coefficients X(M+i) during said decoding are calculated as follows:

$$X(M+i)=X(M-K+i) \text{ or}$$

$$X(M+i)=X(M-i-1).$$

65. The system of claim 63, wherein said modification module is configured to choose transform coefficients X(M+i) during said decoding are chosen randomly with a normalized gain, or to choose said transient transform coefficients X(M+i) during said decoding using linear prediction based on other coefficients out of said transient transform coefficients X(j) using a further predetermined criterion.

66. The system of claim 63, wherein said frame of said acoustic signal follows a first frame of said acoustic signal encoded using a first encoding method, and said frame is a transient frame containing M samples and encoded using a second encoding method for producing a set of said M+K transform coefficients X(j), wherein M and K are pre-selected integers of at least a value of one.

67. The system of claim 66, wherein a decision for using said first encoding method or said second encoding method is made based on a pre-selected criterion.

68. The system of claim 66, wherein said first encoding method is a time domain codec, or a code excited linear prediction.

69. The system of claim 66, wherein for facilitating said encoding of said transient frame, the system further comprises:

a long transform window block, for performing a transform analysis of said transient frame for generating in a frequency domain M transient transform coefficients;

a short transform window block, for performing said transform analysis of at least one further frame for generating in the frequency domain K further transform coefficients, wherein said further frame contains selected samples from both the first frame and the transient frame and said selected samples are chosen based on a predetermined algorithm; and a transform coefficient combining block, for combining said M transient transform coefficients and said K further transform coefficients using a predetermined procedure, for generating said M+K combined transform coefficient X(j).

70. The system of claim 69, wherein said at least one further frame comprises an ending part of said first frame and a beginning part of said transient frame based on said predetermined algorithm.

71. The system of claim 69, wherein said M transform coefficients correspond to a long transient window with a length of L samples, and said K further transform coefficients correspond to a short transient window with a length of $L_s$ samples, and wherein L and $L_s$ are pre-selected integers with L>M and $L_s$>K.

72. The system of claim 71, wherein said long transient window starts from a first sample of said transient frame and extends over a following frame, and optionally L=2M and $L_s$=2K.

73. The system of claim 69, wherein said transform analysis is a lapped transform analysis or a modified discrete cosine transform analysis.

74. The system of claim 69, further comprises:

a transform coefficient removing block, for setting said transform coefficients X(M+i) to zero, thus completing said encoding said transient frame; and a transmitting block for sending all encoded frames including said transient frame for decoding.

75. The system of claim 74, further comprises:

a receiving block for receiving all encoded frames; and a decoder configured for decoding said first frame in the time domain.

* * * * *

UNITED STATES PATENT AND TRADEMARK OFFICE

CERTIFICATE OF CORRECTION

PATENT NO. : 7,386,445 B2
APPLICATION NO. : 11/039391
DATED : June 10, 2008
INVENTOR(S) : Pasi Ojala It is certified that error appears in the above-identified patent and that said Letters Patent is hereby corrected as shown below:

In column 15, line 4, claim 4, line 1 “the step of” should be deleted.
In column 19, line 39, claim 47, line 7 “fu rther” should be --further--.
In column 21, line 28, claim 65, line 3 “are chosen” should be deleted.
In column 22, line 37, claim 74, line 2 “for setting” should be deleted and --configured to set-- should be inserted.

Signed and Sealed this

Eighteenth Day of November, 2008

JON W. DUDAS
*Director of the United States Patent and Trademark Office*